US007177803B2

(12) United States Patent
Boillot et al.

(10) Patent No.: US 7,177,803 B2
(45) Date of Patent: Feb. 13, 2007

(54) METHOD AND APPARATUS FOR ENHANCING LOUDNESS OF AN AUDIO SIGNAL

(75) Inventors: Marc A. Boillot, Plantation, FL (US); John G. Harris, Gainesville, FL (US); Thomas L. Reinke, Gainesville, FL (US); Zaffer S. Merchant, Parkland, FL (US); Jaime A. Borras, Hialeah, FL (US)

(73) Assignee: Motorola, Inc., Schaumburg, IL (US)

( * ) Notice: Subject to any disclaimer, the term of this patent is extended or adjusted under 35 U.S.C. 154(b) by 496 days.

(21) Appl. No.: 10/277,407

(22) Filed: Oct. 22, 2002

(65) Prior Publication Data

US 2004/0024591 A1 Feb. 5, 2004

Related U.S. Application Data

(60) Provisional application No. 60/343,741, filed on Oct. 22, 2001.

(51) Int. Cl.
*G10L 19/00* (2006.01)

(52) U.S. Cl. ..... 704/209

(58) Field of Classification Search ..... None
See application file for complete search history.

(56) References Cited

U.S. PATENT DOCUMENTS 6,507,820 B1 * 1/2003 Deutgen ..... 704/500
6,539,355 B1 * 3/2003 Nishiguchi et al. ..... 704/268
6,813,600 B1 * 11/2004 Casey, III et al. ..... 704/200.1
6,889,182 B2 * 5/2005 Gustafsson ..... 704/205

OTHER PUBLICATIONS

Boillot, M.A., and Harris, J.G., "A Loudness Enhancement Technique for Speech." (UNPUBLISHED).

Boillot, M.A., and Harris, J.G., "A Warped Bandwidth Expansion Filter." (UNPUBLISHED).

Boillot, M.A., and Harris, J.G., "A Loudness Approximation to the ISO-532B." (UNPUBLISHED).

Reinke, T.L., Skowronski, M.D., and Harris, J.G., "Speech Intelligibility Enhancement: Energy Redistribution Using Vocalic and Transitional Cues." (UNPUBLISHED.

* cited by examiner

*Primary Examiner*—Susan McFadden
(74) *Attorney, Agent, or Firm*—Scott M. Garrett

(57) ABSTRACT

Human hearing perceives loudness based on critical bands corresponding to different frequency ranges. As a sound's frequency spectrum increases beyond a critical band into a previously unexcited critical band, the perception is that the sound has increased in loudness. To take advantage of this principle, a filter is applied to a speech signal so as to expand the formant bandwidths of formants in the speech sample.

5 Claims, 3 Drawing Sheets

METHOD AND APPARATUS FOR ENHANCING LOUDNESS OF AN AUDIO SIGNAL

TECHNICAL FIELD

This invention relates in general to speech processing, and more particularly to enhancing the perceived loudness of a speech signal without increasing the power of the signal.

BACKGROUND OF THE INVENTION

Communication devices such as cellular radiotelephone devices are in widespread and common use. These devices are portable, and powered by batteries. One key selling feature of these devices is their battery life, which is the amount of time they operate on their standard battery in normal use. Consequently, manufacturers of communication devices are constantly working to reduce the power demand of the device so as to prolong battery life.

Some communication devices operate at a high audio volume level, such as those providing dispatch call capability. An example of such devices are those sold under the trademark "iDEN," and manufactured by Motorola, Inc., of Schaumburg, Ill. These devices can operate in either a telephone mode, which has a low audio level for playing received audio signals in the earpiece of the device, or a "dispatch" or two-way radio mode where a high volume speaker is used. The dispatch mode is similar to a two-way or so called walkie-talkie mode of communication, and is substantially simplex in nature. Of course, when operated in the dispatch mode, the power consumption of the audio circuitry is substantially more than when the device is operated in the telephone mode because of the difference in audio power in driving the high volume speaker versus the low volume speaker. Of course, it would be beneficial to have a means by which the loudness of a speech signal can be enhanced without increasing the audio power of the signal, so as to conserve battery power. Therefore there is a need to enhance the efficiency of providing high volume audio in these devices.

DETAILED DESCRIPTION OF A PREFERRED EMBODIMENT

Figure 1:
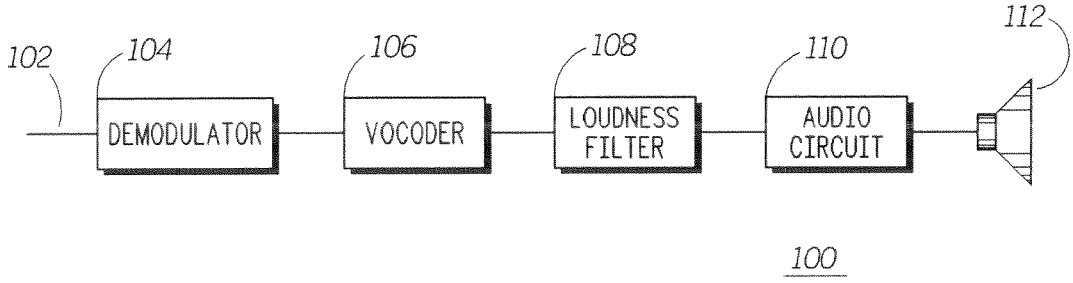
FIG. 1 shows a block diagram of a receiver section of a mobile communication device for employing the invention.

While the specification concludes with claims defining the features of the invention that are regarded as novel, it is believed that the invention will be better understood from a consideration of the following description in conjunction with the drawing figures, in which like reference numerals are carried forward.

The invention takes advantage of psychoacoustic phenomena, and enhances the perceived loudness without increasing the power of the audio signal, and applies filters that selectively expand the bandwidth of formant regions in vowelic speech. These principles resulted from research described in three papers disclosed herewith, and titled "A Loudness Approximation To The ISO-532B"; "A Loudness Enhancement Technique For Speech"; and "A Warped Bandwidth Expansion Filter," all written by Boillot and Harris; and hereby incorporated by reference. It is well known in psychoacoustic science that the perception of loudness is dependent on critical band excitation in the human auditory system. Loudness of sound, as a quantitative parameter, has been addressed by ISO-532B, "Acoustics—method for calculating loudness level" of the International Standards Organization. Loudness is the human perception of intensity and is a function of the sound intensity, frequency, and quality. Intensity is the amount of energy flowing across a unit area over a unit of time. It closely follows an inverse square law with distance as described by:

$$L = 10\log_{10}\frac{I1}{I2} \quad L = 20\log_{10}\frac{p1}{p2}$$

where L is loudness, I is intensity, and p is acoustic pressure. The sound energy can be represented with pressure since $I \propto p^2$. When the denominator values are chosen as reference variables corresponding to the threshold of hearing, the decibel pressure ratio becomes the sound pressure level (SPL) and the decibel intensity ratio becomes the intensity level. The loudness parameter was modeled to characterize the loudness sensation of any sound because magnitude estimations do not provide an accurate representation of what the human auditory system perceives. By definition, the loudness of a sound is the sound pressure level of a 1 KHz tone that is perceived to be as loud as the sound under test. The unit of measure for expressing loudness with this method is the phon, which is an objective value to relate the perception of loudness to the SPL.

The phon, however, does not provide a measure for the scale of loudness. A loudness scale provides a unit of measure expressing how much louder one sound is perceived in comparison to another. The phon level simply state the SPL level required to achieve the same loudness level. It does not establish a metric, or unit of loudness. The sone was introduced to define a subjective measure of loudness where a sone value of 1 corresponds to the loudness of a 1 KHz tone at an intensity of 40 dB SPL for reference. The sone scale defines a scale of loudness such that quadrupling of the sone level quadruples the perceived loudness. An empirical relation between the sound pressure p and the loudness S in sones is typically given by $S \propto p^{0.6}$. A tenfold increase in intensity corresponds to a 10 phon increase in SPL. Since loudness is proportional to the cube root of the intensity, a 10 phon increase toughly corresponds to a doubling of the sone value. The sound is perceived as being twice as loud.

The most dominant concept of auditory theory is the critical band. The critical band defines the processing channels of the auditory system on an absolute scale with our representation of hearing. The critical band represents a constant physical distance along the basilar membrane of about 1.3 millimeters in length. It represent the signal processes within a single auditory nerve cell or fiber. Spectral components falling together in a critical band are processed together. The critical bands are independent processing channels. Collectively they constitute the auditory representation of sound. The critical band has also been regarded as the bandwidth in which sudden perceptual changes are noticed. Critical bands were characterized by experiments of masking phenomena where the audibility of a tone over noise was found to be unaffected when the noise in the same critical band as the tone was increased in spectral width, but when it exceeded the bounds of the critical band, the audibility of the tone was affected. Experimental results have shown that critical band bandwidth increases with increasing frequency. Furthermore, it has been found that when the frequency spectral content of a sound is increased so as to exceed the bounds of a critical band, the sound is perceived to be louder, even when the energy of the sound has not been increased. This is because the auditory processing of each critical band is independent, and their sum provides an evaluation of perceived loudness. By assigning each critical band a unit of loudness, it is possible to assess the loudness of a spectrum by summing the individual critical band units. The sum value represents the perceived loudness generated by the sound's spectral content. The loudness value of each critical band unit is a specific loudness, and the critical band units are referred to as Bark units. One Bark interval corresponds to a given critical band integration. There are approximately 24 Bark units along the basilar membrane, corresponding to 640 audible frequency modulation steps. The critical band scale is a frequency-to-place transformation of the basilar membrane. The principle observation of the critical band is that it can be interpreted as a rate scale, i.e. loudness does not increase until a critical band has been exceeded by the spectral content of a sound. The invention makes use of this phenomenon by expanding the bandwidth of certain peaks in a given portion of speech, while lowering the magnitude of those peaks.

Referring now to FIG. 1, there is shown a block diagram of a receiver portion of a mobile communication device 100. The receiver receives a radio frequency signal at an input 102 of a demodulator 104. As is known in the art, radio frequency signals are typically received by an antenna, and are then amplified and filtered before being applied to a demodulator. The demodulator demodulates the radio frequency signal to obtain vocoded voice information, which is passed to a vocoder 106 to be decoded. The vocoder here is recreating a speech signal from a vocoded speech signal using linear predictive (LP) coefficients, as is known in the art. The LP coefficients indicate whether the present speech frame being generated by the vocoder is voiced, and the degree of voicing. Another parameter obtained in this process is the spectral flatness measure which indicates tonality. A high tonality and voicing value indicates the present speech frame is vowelic, and has substantial periodic components. The invention applies a post filter 108 to the speech frame from the vocoder, and in the preferred embodiment the filter is applied selectively, depending on the amount of vowelic content of the speech frame, as indicated by the spectral flatness parameter. The speech frame is then passed to an audio circuit 110 where it is played over a speaker 112.

The filter expands formant bandwidths in the speech signal by scaling the LP coefficients by a power series of r, given in equation 2 as:

$$A(\tilde{z})\big|_{z=re^{jw}} = \sum_{k=0}^{p} (a_k r^{-k}) e^{-jwk}$$

This technique is common to speech coding and has been used as a compensation filter for the bandwidth underestimation problem and as a postfilter to enhance the relative quality of vocoded speech due to quantization. Spectral shaping can be achieved using a filter according to equation 3:

$$H(z) = \frac{A(z/\alpha)}{A(z/\beta)}$$

The filter in the invention is implemented with $\alpha=1$, but in other application where it is used to improve the overall quality of synthesized speech it is used with $\alpha\neq1$. The filter provides a way to evaluate the Z transform on a circle with radius greater than or less than the unit circle. For $0<r<1$ the evaluation is on a circle closer to the poles and the contribution of the poles has effectively increased, thus sharpening the pole resonance. Stability is a concern since $1/A(\tilde{z})$ no longer an analytic expression within the unit circle. For $r>1$ (bandwidth expansion) the evaluation is on a circle farther away form the poles and thus the pole resonance peaks decrease and the pole bandwidths are widened. The poles are always inside the unit circle and $1/A(\tilde{z})$ is stable.

Figure 2:
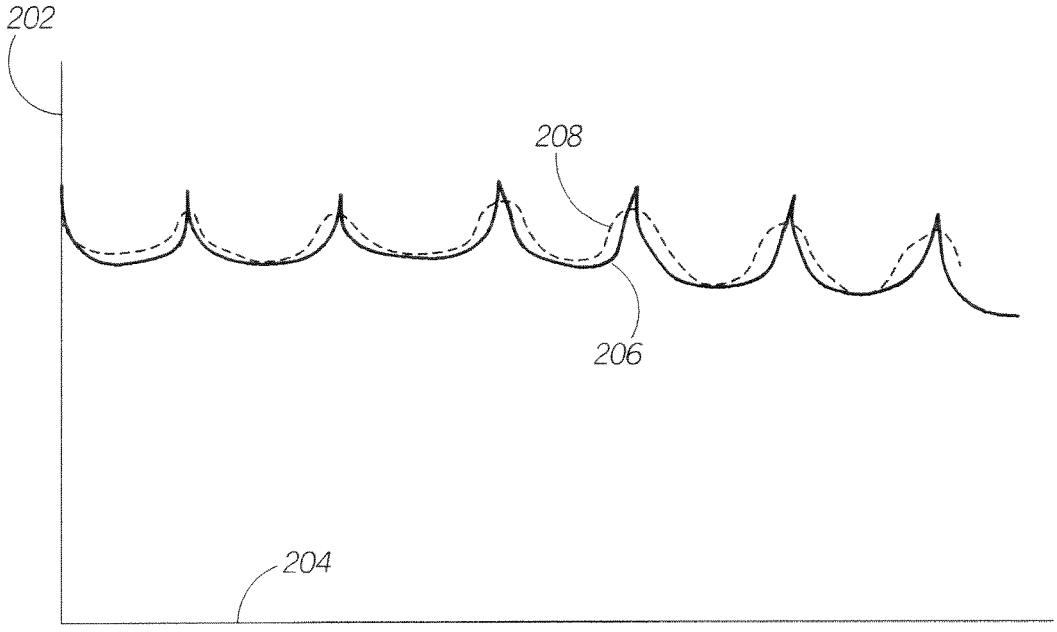
FIG. 2 shows a graph chart of unfiltered speech and speech filtered in accordance with the invention.
Figure 3:
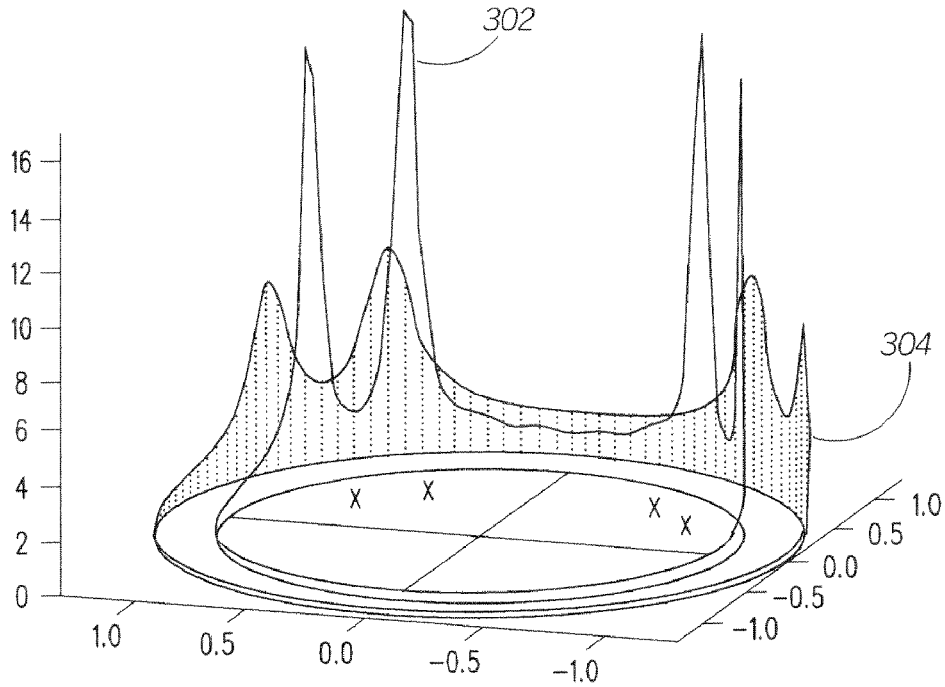
FIG. 3 shows a graph chart of unfiltered speech and speech filtered in accordance with the invention.

This filter technique of formant bandwidth expansion has been used to correct vocoder digitization errors, but not to expand the bandwidth any more than necessary to correct such errors because it is well known that sharper and narrower peaks increase the intelligibility of speech. However, it has been discovered through testing that the formant bandwidths may be expanded to a degree that enhances the perception of loudness without significantly reducing intelligibility. The effect of the filter is illustrated in FIG. 2, which shows a graph 200 in the frequency domain of a vowelic speech signal. The graph shows magnitude 202 versus frequency 204. The solid line 206 represents the unfiltered speech signal. The peaks represent formants, and the area around the peaks are formant regions. Upon application of the filter 108, the formant bandwidths are expanded, as represented by the dashed line 208. FIG. 3 shows another graphical representation 300 of unfiltered speech 302 and filtered speech 304 in the z plane. The filtered speech 304 uses the filter equation shown above where r is greater than 1. If the poles are well separated, as in the case of formants, then the bandwidth B of a complex pole can be related to the radius r at a sampling frequency $f_s$ by:

$$B=-\log(r)f_s/\pi(\text{Hz})$$

This follows from an s-plane result that the bandwidth of a pole in radians/second is equal to twice the distance of the pole from the jw-axis when the pole is isolated from other poles and zeros.

Thus, the invention increases loudness without increasing the energy of the speech signal by expanding the bandwidth of formants in a speech signal. The technique was applied on a real time basis (frame by frame). We used $6^{th}$-order LP coefficient analysis with a bandwidth expansion factor of r=1.2, 32 millisecond frame size, 50% frame overlap, and per frame energy normalization. Filter states were preserved form each frame to the next and no sub-frame interpolation of coefficients was applied. Durbin's method with a Hamming window was used for the autocorrelation LP coefficient analysis. All speech examples were bandlimited between 100 Hz and 16 KHz. Each frame was passed through a filter implementing filter equation 1, given hereinabove, with $\alpha=1$ and $\beta=r$ and reconstructed with the overlap and add method of triangular windows. The bandwidth has been expanded for loudness enhancement to the point at which a change in intelligibility is noticeable but still acceptable.

A subjective listening test of random words were selected for presentation to a listener. The test consisted of 240 utterances ($f_s$=10 KHz) at a comfortable listening level. The listener listened to the speech utterances through Sony MDR-V200 padded headphones. The test took about 15 minutes for each of 13 participants who were untrained in audiology.

The listening test was a graphical user interface which presented the listener an option to select which of two sounds of equal energy sounded louder to the listener. One word was the original and the other was the filtered version with formant bandwidth expansion. To determine the potential decibel gain improvement, a decibel scaling of the modified words was transparently included in the test. The modified words were randomly scaled between −1 and −3 decibel, and the user was given no information as to which word was modified, or how much it was scaled. The results of these choices roughly determine by how many decibels the bandwidth expansion technique can perceptually improve loudness. A conservative loudness gain of 1–2 decibels at a 95% confidence level is within reason.

Figure 4:
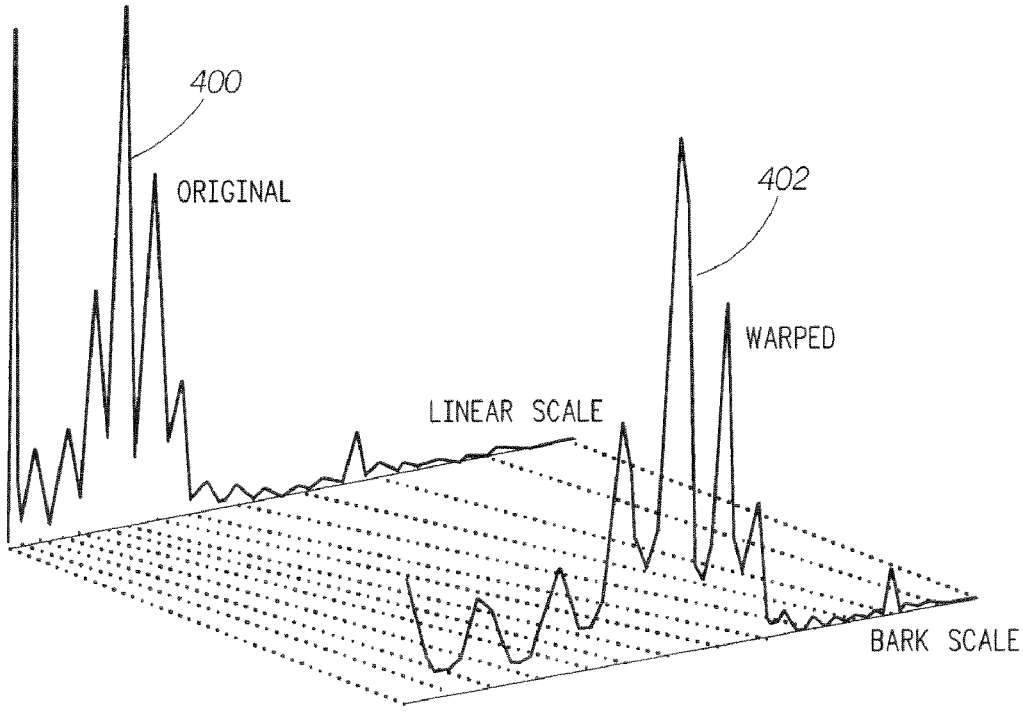
FIG. 4 shows transformation diagram of a transformed speech signal in accordance with a warping filter of the invention.

To further enhance the filter design, an additional filter is used to warp the speech from a linear frequency scale to a Bark scale so as to expand the bandwidths of each pole on a critical band scale closer to that of the human auditory system. FIG. 4 shows an example of a mapping of a speech signal spectrum from a linear scale 400 to a Bark scale 402. Warped filters have primarily been used for audio filter design to better model the frequency response to that of human hearing. Since warped filter structures are realizable, the linear bandwidth expansion technique can be used in the warped signal. Warped linear prediction uses allpass filters in the form of:

$$\tilde{z}^{-1} = \frac{z^{-1} - \alpha}{1 - \alpha z^{-1}}$$

An allpass factor of $\alpha=0.47$ provides a critical band warping. The transformation is a one-to-one mapping of the z domain and can be done recursively using the Oppenheim recursion. FIG. 4 show the result of an Oppenheim recursion with $\alpha=0.47$. The recursion can be applied to the autocorrelation sequence $R_n$, power spectrum $P_n$, prediction parameters $a_p$, or cepstral parameters. We used the Oppenheim recursion on the autocorrelation sequence for the frequency warping transformation.

The warped prediction coefficients $\tilde{a}_k$ define the prediction error analysis filter given by:

$$\tilde{A}(z) = 1 - \sum_{k=1}^{p} \tilde{a}_k z^{-k}(z)$$

and can be directly implemented as an FIR filter with each unit delay being replaced by an allpass filter. However, the inverse IIR filter is not a straightforward unit delay replacement. The substitution of allpasses into the unit delay of the recursive IIR form creates a lag free term in the delay feedback loop. The lag free term must be incorporated into a delay structure which lags all terms equally to be realizable. Realizable warped recursive filter designs to mediate this problem are known. One method for realization of the warped IIR form requires the allpass sections to be replaced with first order lowpass elements. The filter structure will be stable if the warping is moderate and the filter order is low. The error analysis filter equation given immediately above can be expressed as a polynomial in $z^{-1}/(1-\alpha z^{-1})$ to map the prediction coefficients to a coefficient set used directly in a standard recursive filter structure. In this manner the allpass lag-free element is removed form the open loop gain and realizable warped IIR filter is possible. The $b_k$ coefficients are generated by a linear by a linear transform of the warped LP coefficients, using binomial equations or recursively. The bandwidth expansion technique can be incorporated into the warped filter and are found from $$b_k = \sum_{n=k}^{p} C_{kn}\tilde{a}_n \quad C_{kn} = \binom{n}{k}(1-\alpha^2)^k(-\alpha)^{n-k}r^{-n}$$

Figure 5:
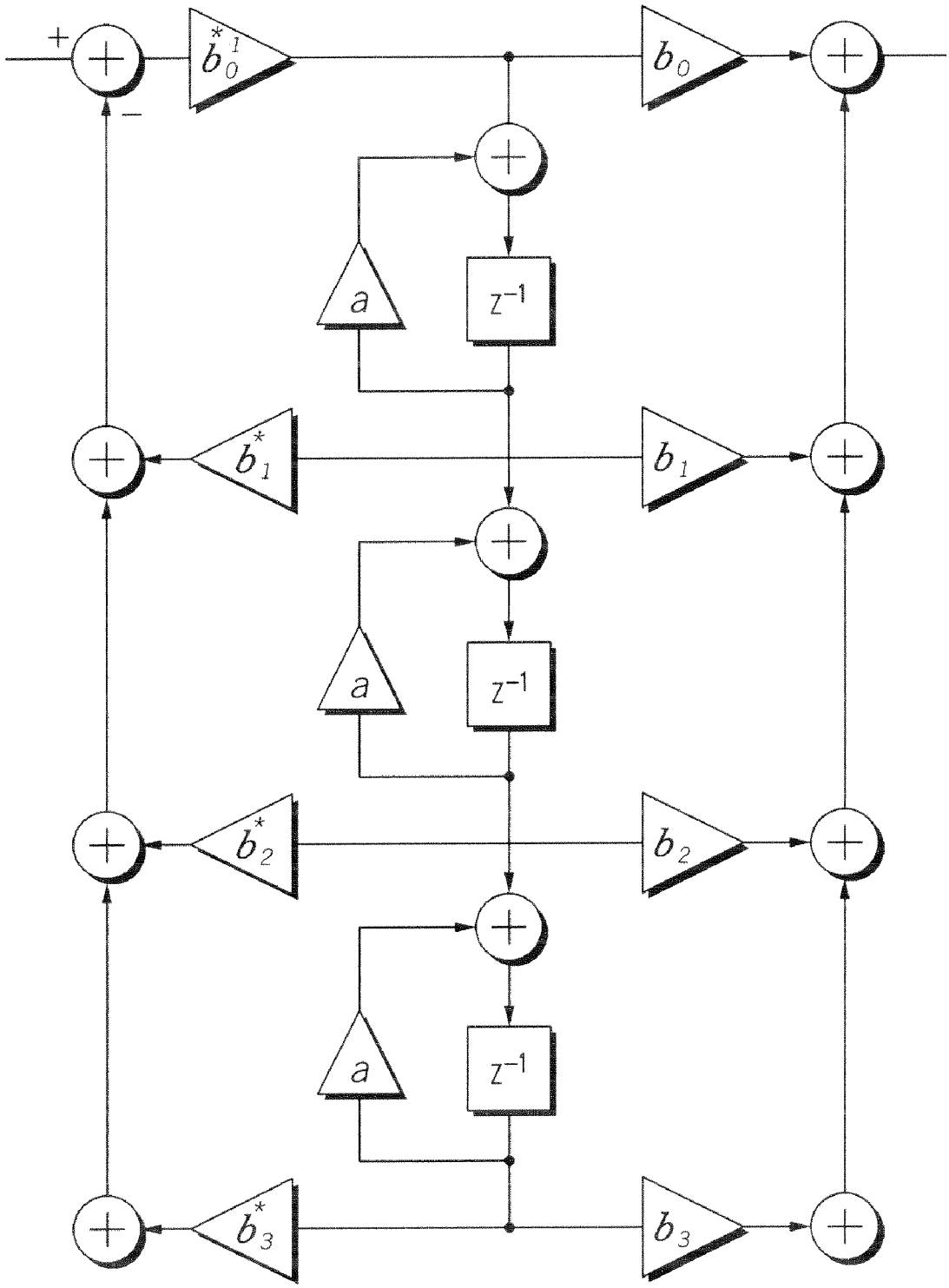
FIG. 5 shows a canonic form of a filter for filtering speech to increase the perceived loudness of the speech, in accordance with the invention.

The $b_k$ coefficients are the bandwidth expanded terms in the IIR structure. FIG. 5 shows the canonic form of the warped LP coefficient (WLPC) filter. The WLPC filter can be put in the same form as a general vocoder post filter, and is represented by $$H(z) = \frac{A(\tilde{z})}{A(\tilde{z}/\beta)}$$

The numerator generates the warped excitation sequence which is resynthesized into the nonlinear bandwidth expanded signal using the denominator. The denominator convolves the excitation with the vocal tract model. This stage includes the radius factor for altering formant bandwidth. The warped filter effectively expands higher frequency formants by more than it expands lower frequency formants.

Thus, the invention provides a means for increases the perceived loudness of a speech signal or other sound without increasing the energy of the signal by taking advantage of psychoacoustic principle of human hearing. The perceived increase in loudness is accomplished by expanding the formant bandwidths in the speech spectrum on a frame by frame basis so that the formants are expanded beyond their natural bandwidth. The filter expands the formant bandwidths to a degree that exceeds merely correcting vocoding errors, which is restoring the formants to their natural bandwidth. Furthermore, the invention provides for a means of warping the speech signal so that formants are expanded in a manner that corresponds to a critical band scale of human hearing.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method for increasing the perceived loudness of a speech signal, comprising:

receiving a vocoded speech signal;

recreating the speech signal from the vocoded speech signal, the speech signal having a plurality of formants and an energy, each formant having a natural bandwidth; and filtering the speech signal to expand a bandwidth of each of the plurality of formants beyond their natural bandwidth without increasing the energy of the speech signal.

2. A method for increasing the perceived loudness of a speech signal as defined in claim 1, wherein the speech signal is warped so as to expand formant bandwidths in a manner dependent on a frequency of the formant.

3. A method for increasing the perceived loudness of a speech signal as defined in claim 1, wherein the filter is selectively applied when the speech signal has significant vowelic content.

4. A method for increasing the perceived loudness of a speech signal as defined in claim 3, wherein the vowelic content is indicated by a spectral flatness measure of the speech signal.

5. An apparatus for increasing the loudness of a speech signal, comprising:

a demodulator for receiving a radio frequency signal and providing a vocoded speech signal from the radio frequency signal;

a vocoder coupled to the demodulator for recreating the speech signal from the vocoded speech signal, the speech signal, the speech signal having a plurality of formants and an energy, each formant having a natural bandwidth; and a post filter coupled to the vocoder for filtering the speech signal to expand a bandwidth of each of the plurality of formants beyond their natural bandwidth without increasing the energy of the speech signal.

* * * * *